US006293358B1

(12) United States Patent
Jäger

(10) Patent No.: US 6,293,358 B1
(45) Date of Patent: Sep. 25, 2001

(54) MACHINE OPERATING ACCORDING TO THE MOINEAU-PRINCIPLE FOR THE USE IN DEEP DRILLING

(75) Inventor: Sebastian Jäger, Hannover (DE)

(73) Assignee: Artemis Kautschuk und Kunstofftechnik GmbH & Cie (DE)

( * ) Notice: Subject to any disclaimer, the term of this patent is extended or adjusted under 35 U.S.C. 154(b) by 0 days.

(21) Appl. No.: 09/336,466

(22) Filed: Jun. 18, 1999

(30) Foreign Application Priority Data

Jun. 18, 1998 (DE) ..... 198 27 101

(51) Int. Cl.[7] ..... E21B 4/00
(52) U.S. Cl. ..... 175/107; 418/48
(58) Field of Search ..... 418/48, 83, 153, 418/178; 175/107, 57, 325.1

(56) References Cited

U.S. PATENT DOCUMENTS 3,912,425 * 10/1975 Tschirky et al. ..... 418/48
4,098,561 * 7/1978 Tschirky et al. ..... 418/48
4,187,061 * 2/1980 Jurgens ..... 418/48
4,669,961 * 6/1987 Lorett ..... 418/1
5,096,004 * 3/1992 Ide ..... 175/107
5,171,138 12/1992 Forrest .
5,171,139 * 12/1992 Underwood et al. ..... 418/48
5,407,337 * 4/1995 Appleby ..... 418/166
5,439,359 * 8/1995 Leroy et al. ..... 418/48
5,549,160 * 8/1996 Bownes et al. ..... 166/250.08
5,603,608 * 2/1997 Marz ..... 417/13

* cited by examiner

*Primary Examiner*—Victor Batson
(74) *Attorney, Agent, or Firm*—R. W. Becker & Associates; R. W. Becker

(57) ABSTRACT

A Moineau machine has an outer tubular member and an inner tubular member mounted in the outer tubular member whereby the inner tubular member is movable in the axial direction of the outer tubular member but is axially securable in a desired position relative to the outer tubular member. The inner tubular member has an inner surface. An inner elastomer lining is fixedly connected to the inner surface. The inner tubular member has a wall thickness smaller than the outer tubular member. The inner tubular member has opposed ends wherein at least one of the opposed ends is sealed relative to the inner wall of the outer tubular member.

4 Claims, 1 Drawing Sheet

MACHINE OPERATING ACCORDING TO THE MOINEAU-PRINCIPLE FOR THE USE IN DEEP DRILLING

BACKGROUND OF THE INVENTION

The present invention relates to a machine operating according to the Moineau-Principle for use in deep drilling, especially a drill motor, whereby within an unslotted, tubular external part, usually embodied as a stator, a helical inner portion, usually embodied as a rotor, is positioned, wherein the external part is provided with an inner helical lining consisting of an elastomer for receiving the inner part. The exterior part and the inner part can be rotated relative to one another.

In the field of deep drilling, for example, for oil production, machine lengths of multiple meters are required, and, accordingly, large exterior parts in the form of comparatively thick walled, very strong and stable, expensive pipes are needed. It is understood that under these conditions the application and exchange of an elastomer lining at the inner side of the exterior part is very difficult.

It is therefore an object of the present invention to embody the aforementioned machine such that the aforementioned exterior parts can be produced in a substantially simplified manner and that furthermore the lining can be exchanged.

SUMMARY OF THE INVENTION

As a solution to this object, it is inventively suggested to fixedly connect the lining comprised of an elastomer to the inner surface of a tube which is comprised of steel or a similar, stable material, whereby the tube is in the following referred to as the inner tubular member. The inner tubular member is arranged to be longitudinally slidable but securable within the exterior part (outer tubular member). The inner tubular member has a substantially reduced wall thickness relative to the outer tubular member and is sealed relative to the inner surface of the outer tubular member with respect to penetration of conveying or pressure media at its two ends.

With this solution it is possible to produce the lining, which is subject to wear, together with a thin walled tubular body which is of reduced stability and to insert this tubular body together with the lining into the outer tubular member or to remove the inner tubular member, after the lining is worn, from the outer tabular member.

This solution also allows to select a very thin lining which in itself is insufficient with regard to stiffness considerations and to produce the inner tubular member of a smooth, cylindrical tube to which is imparted the shape of the helical lining, whereby optionally the ends of the inner tubular member are embodied to be cylindrical and to match the inner diameter of the outer tubular member.

In order to secure the inner tubular member against axial movement and rotation, the ends of this inner tubular member can be provided with connecting elements, respectively, stop members, which are connected by welding are connected by a threaded connection so as to be detachable. Preferable, these connecting elements are embodied simultaneously as sealing means or are embodied so as to be adapted for receiving separate sealing means.

BRIEF DESCRIPTION OF THE DRAWINGS

The object and advantages of the present invention will be explained in more detail with the aid of the accompanying drawings, in which.

DESCRIPTION OF PREFERRED EMBODIMENTS

Figure 1:
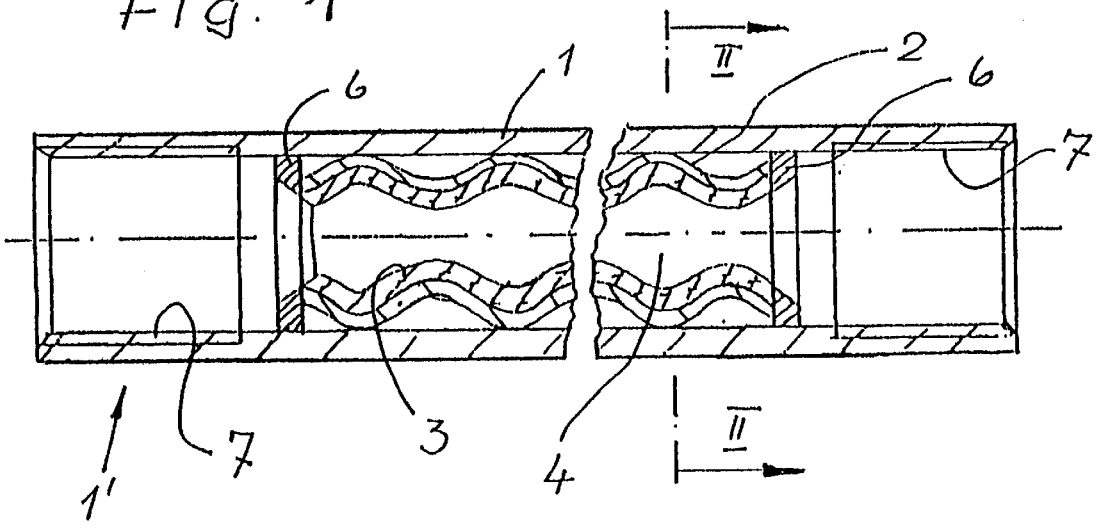
FIG. 1 shows a part-sectional view of the stator arranged vertically in its operating position, of a drill motor for driving drilling tools for deep drilling in soil.
Figure 2:
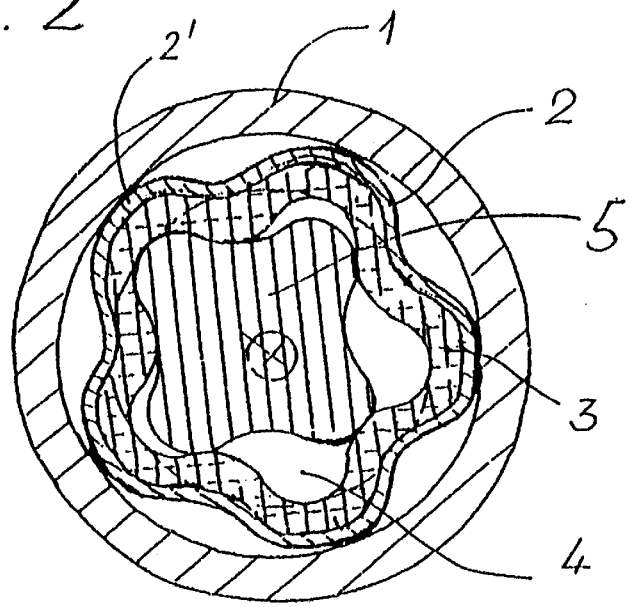
FIG. 2 shows a section along the line II—II of FIG. 1 together with the rotor.

The present invention will now be described in detail with aid of several specific embodiments utilizing FIGS. 1 through 4.

The stator is comprised substantially of a strong, unslotted, cylindrical outer tubular member 1 consisting of a highly stable steel and further comprised of an inner tubular member 2 resting at the inner surface of the outer tubular member 1, whereby the inner tubular member 2 is provided with a lining 3 consisting of rubber which is attached to the inner wall of the inner tubular member 2. This lining 3 encloses an elongated hollow space 4 for receiving a rotor 5. The rotor 5 extends freely in the upward direction. In the downward direction it has a non-represented coupling member to be engaged by a jointed shaft etc. which is provided for compensating the eccentricity and for driving a tool, for example, a drill bit.

According to the Moineau-Principle, the lining 3 is of a helical design and is provided, in comparison to the outer helical design of the rotor 5, with one more helical projection or thread. The arrangement can be seen in FIG. 2. Accordingly, the rotor 5 has four helical threads or projections and the lining 3 has five helical threads or projections in order to thus provide the required pressure chambers therebetween for driving the rotor by the liquid drive medium.

It is of special importance that the lining 3 is not connected to the inner wall of the outer tubular member 1, but to the inner surface of the inner tubular member 2, whereby a fixed connection is provided which can be realized by vulcanization. Furthermore, the inner tubular member 2 is shaped according to inner helical design (helical surface) of the lining 3, whereby, however, an inner tubular member 2 is selected that has a relatively thin wall whereby its wall thickness is substantially smaller than that of the outer tubular member 1. The wall thickness should be approximately 20% to 70% of the wall thickness of the outer tubular member 1. Furthermore, the wall thickness of the inner tubular member 2 is substantially smaller than that of the lining 3. The ratio here is expediently approximately 20% to 50%.

This comparatively small wall thickness of the inner tubular member 2 has great advantages. Firstly, the free cross section of the hollow space 4 is not reduced by a considerable amount, and, on the other hand, a minimal thickness can be selected because the bulges 2' resulting from the helical design can be supported on the inner wall of the outer tubular member 1. Accordingly, the very thin wall of the inner tubular member 2 is not prone to deformation during operation of the motor. Furthermore, it is possible to employ thin walled cylindrical pipes for producing the inner tubular member 2 which can be produced by a permanent deformation process according to known methods.

At both ends of the inner tubular member 2, annular discs (rings) 6 are connected which can also be connected to the outer tubular member 1. This prevents axial movement and rotation of the inner tubular member 2. At the same time, these annular discs 6 serve as a sealing means of the inner tubular member 2 relative to the outer tubular member 1 so that undesirable penetration of drill fluids etc. is prevented. In general, it is sufficient to provide only one end of the inner helical member 2 with a seal whereby preferably the seal is provided at the upper end of the inner tubular member 2 in order to provide for pressure compensation at greater depths of the bore hole.

The attachment of the annular discs or rings 6, which at the effective side 1' of the motor only rest at the end face of the inner tubular member 2 in order to have no negative effect on the deformability of the lining 3, can be achieved by welding, but also by threading when employing the inner threads 7 already provided at both ends of the outer tubular member 1.

The inner tubular member 2 can also be provided with cylindrical end pieces that are produced from the pipe blank, whereby these cylindrical end pieces have an outer diameter that matches the inner diameter of the outer tubular member 1. In this manner, the need for annular discs 6 can be completely or partly eliminated, i.e., the end pieces take over the function of the annular discs.

Preferably, the inner tubular member 2 is embodied as a helical tube in order to thus provide over the length of the lining 3 and its circumference substantially the same wall thickness for the rubber of the lining 3. However, the inner tube 2 can also be cylindrical.

Once the lining 3 has been damaged or is worn, the inner tubular member 2 is removed together with the lining 3 from the outer tubular member 1, after a locking means, respectively, a stop member at one end of the inner tubular member 2 has been removed.

As can been seen in FIG. 1, the inner tubular member 2 with its lining 3 extends into the vicinity or to the inner thread 7, whereby the inner thread 7, as is conventional, provides the connection to the adjacently positioned parts of the drill motor, but, in an alternative embodiment, it is also possible to employ these inner threads 7 for attachment of detachable annular discs 6 or similar arresting and/or sealing means for the ends of the inner tubular member 2.

Figure 3:
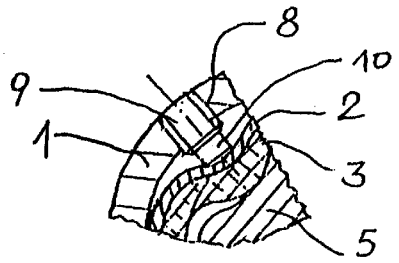
FIG. 3 shows a part-sectional view of a different embodiment of the stator in a view similar to FIG. 2.
Figure 4:
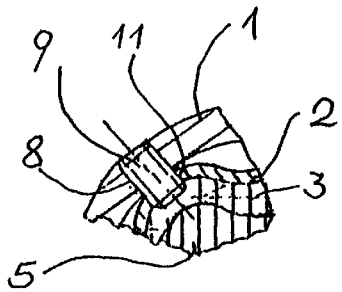
FIG. 4 shows a part-sectional view of yet another embodiment of the stator in a view similar to FIG. 2.

In FIGS. 3 and 4, special measures are represented for securing the inner tubular member 2 relative to the outer tubular member 1 against rotation and/or axial movement.

The tubular outer member 1 is provided with a threaded bore 8 into which a bolt 9 is threaded which projects into the interior of the outer tubular member 1. According to FIG. 3, the bolt 9 engages with a cylindrical projection 10 the space between two adjacently positioned bulges of the helical design of the inner tubular member 2 for securing the inner tubular member 2. The resulting positive-locking action secures the inner tubular member 2.

In the embodiment according to FIG. 4, the inner tubular member 2 is provided with a thread 11 into which the bolt 9, threaded into the threaded bore 8, can be threaded. It is also possible to eliminate the thread within in the inner tube 2; it is sufficient to provide a penetration in the inner tubular member that can be engaged by a short stump end of the projection 10 of the bolt 9 whereby however the penetration depth can only be very minimal in order not to compromise the deformability of the lining 3.

The invention provides considerable advantages with respect to recycling of such machines. The possibly worn lining 3 is removed together with the inner tube 2 from the outer tubular member 1 and is replaced by new elements 2, 3. These measures are advantageous because the inner tubular member 2 is thin walled and can be manufactured from a material of lesser quality and strength in comparison to the prior art tubular members.

The specification incorporates by reference the disclosure of German priority document 198 27 101.8 of Jun. 18, 1998.

The present invention is, of course, in no way restricted to the specific disclosure of the specification and drawings, but also encompasses any modifications within the scope of the appended claims.

What is claimed is:

1. A Moineau machine comprising:

an outer tubular member (1);

an inner tubular member (2) positioned in said outer tubular member (1) and moveable in an axial direction of said outer tubular member (1) but axially securable in a desired position relative to said outer tubular member (1);

said inner tubular member (2) having an inner surface;

an inner elastomer lining (3) fixedly connected to said inner surface, said lining (3) having an inner helical surface;

a helical rotor (5) rotatably mounted in said inner tubular member (2);

said inner tubular member (2) having a wall thickness smaller than a wall thickness of said outer tubular member (1);

said inner tubular member (2) having opposed ends, wherein at least one of said opposed ends is sealed relative to an inner wall of said outer tubular member (1);

said outer tubular member (1) having arresting devices at said inner wall for arresting said inner tubular member (2) in said desired position, said arresting devices selected from the group consisting of stops, locking elements, and radially in wardly projecting bolts;

said inner tubular member (2) having radially outwardly extending bulges (2') and wherein said radially inwardly projecting bolts (9) contact two neighboring ones of said bulges (2').

2. A Moineau machine comprising:

an outer tubular member (1);

an inner tubular member (2) positioned in said outer tubular member (1) and moveable in an axial direction of said outer tubular member (1) but axially securable in a desired position relative to said outer tubular member (1);

said inner tubular member (2) having an inner surface;

an inner elastomer lining (3) fixedly connected to said inner surface, said lining (3) having an inner helical surface;

a helical rotor (5) rotatably mounted in said inner tubular member (2);

said inner tubular member (2) having a wall thickness smaller than a wall thickness of said outer tubular member (1);

said inner tubular member (2) having opposed ends, wherein at least one of said opposed ends is sealed relative to an inner wall of said outer tubular member (1);

said outer tubular member (1) having arresting devices at said inner wall for arresting said inner tubular member (2) in said desired position, said arresting devices selected from the group consisting of stops, locking elements, and radially inwardly projecting bolts;

said inner tubular member (2) having penetrations (11) in which said radially inwardly projecting bolts (9) are inserted.

3. A Moineau machine comprising: an outer tubular member (1);

an inner tubular member (2) positioned in said outer tubular member (1) and moveable in an axial direction of said outer tubular member (1) but axially securable in a desired position relative to said outer tubular member (1);

said inner tubular member (2) having an inner surface;

an inner elastomer lining (3) fixedly connected to said inner surface, said lining (3) having an inner helical surface;

a helical rotor (5) rotatably mounted in said inner tubular member (2);

said inner tubular member (2) having a wall thickness smaller than a wall thickness of said outer tubular member (1);

said inner tubular member (2) having opposed ends, wherein at least one of said opposed ends is sealed relative to an inner wall of said outer tubular member (1);

said outer tubular member (1) having arresting devices at said inner wall for arresting said inner tubular member (2) in said desired position, said arresting devices selected from the group consisting of stops, locking elements, and radially inwardly projecting bolts;

said inner tubular member (2) having penetrations (11) in which said radially inwardly projecting bolts (9) are inserted, said penetrations having an inner thread.

4. A Moineau machine comprising:

an outer tubular member (1) having inner threads (7) for receiving connecting members of said Moineau machine;

an inner tubular member (2) positioned in said outer tubular member (1) and moveable in an axial direction of said outer tubular member (1) but axially securable in a desired position relative to said outer tubular member (1);

said inner tubular member (2) having an inner surface;

an inner elastomer lining (3) fixedly connected to said inner surface, said lining (3) having an inner helical surface;

a helical rotor (5) rotatably mounted in said inner tubular member (2);

arresting devices for arresting said tubular member (2) in said desired position;

sealing elements for sealing said inner tubular member (2) relative to said outer tubular member (1), wherein said inner threads (7) receive said arresting devices and said sealing elements;

said inner tubular member (2) having a wall thickness smaller than a wall thickness of said outer tubular member (1);

said inner tubular member (2) having opposed ends, wherein at least one of said opposed ends is sealed relative to an inner wall of said outer tubular member (1).

* * * * *